United States Patent [19]

Nishibe et al.

[11] Patent Number: 4,958,362

[45] Date of Patent: Sep. 18, 1990

[54] CLOCK SIGNAL GENERATING CIRCUIT

[75] Inventors: Takashi Nishibe; Shotaro Yokoyama, both of Kanagawa, Japan

[73] Assignee: Fuji Electric Co., Ltd., Kanagawa, Japan

[21] Appl. No.: 263,169

[22] Filed: Oct. 27, 1988

[30] Foreign Application Priority Data

Oct. 31, 1987 [JP] Japan ..... 62-277105

[51] Int. Cl.[5] ..... G04F 10/04

[52] U.S. Cl. ..... 377/20; 377/44; 328/61; 328/129.1

[58] Field of Search ..... 328/60, 61, 63, 129.1; 377/20, 44

[56] References Cited

U.S. PATENT DOCUMENTS

| | | | |
|---|---|---|---|
| 3,579,126 | 5/1971 | Paul | 328/129.1 |
| 3,657,658 | 4/1972 | Kubo | 328/61 |
| 3,936,745 | 2/1976 | Harrington | 328/129.1 |
| 3,952,253 | 4/1976 | DeVolpi et al. | 328/61 |
| 4,339,722 | 7/1982 | Sydor et al. | 377/44 |
| 4,737,942 | 4/1988 | Nishibe et al. | 368/118 |

*Primary Examiner*—John S. Heyman

*Attorney, Agent, or Firm*—Finnegan, Henderson, Farabow, Garrett and Dunner

[57] ABSTRACT

A circuit for generating clock signals includes a reference clock signal generator and a 1/N frequency divider for generating 1/N frequency divided clock signals. An up-counter counts the 1/N frequency divided clock signals until the occurrence of a first event. A programmable counter receives both an inverted count result as an initial value from the up-counter and the reference clock signals and counts the reference clock signals up to a predetermined count. When the programmable counter reaches the predetermined count it outputs a carry signal and is reset back to the initial value. As the programmable counter again counts from the initial value to the predetermined count, it again outputs a carry signal. These plurality of carry signals can be counted to provide a count corresponding to the amount of time between the occurrence of plurality of events.

4 Claims, 4 Drawing Sheets

EVENTS
$E_1$
$E_2$
$E_3$
$E_m$
10
(ii)
70
(vii)
30
$\frac{1}{N}$
(iii)
$\phi$
(iv)
20
(v)
40
UP-COUNTER
RESET
R
$C_1$
$\bar{Q}_0$
$\bar{Q}_1$
$\bar{Q}_n$
80
(vi)
50
PROGRAMMABLE COUNTER
$C_2$
$D_0$
$D_1$
$D_n$
CARRY
$Q_0$
$Q_1$
$Q_n$
PROGRAM
50B
50A
60
(ix)
$\phi_S$
INPUT OF AND GATE 140 IN FIG. 4

CLOCK SIGNAL GENERATING CIRCUIT

BACKGROUND OF THE INVENTION

1. Field of the Invention

The present invention relates to a circuit for generating clock signals for measuring occurrence times of different events.

2. Description of the Related Art

When the occurrence times of a plurality of events are to be measured, it is known to use a sensor array formed of a plurality of sensors, the outputs of which represent response times. In such a case, it is known to arrange a plurality of timer circuits for respectively measuring the outputs of the sensors, based on a reference frequency.

FIG. 1 is a block diagram of such a known sensor array time measuring system 1. AND gates 3*a* through 3*n* and counters 4*a* through 4*n* are provided to measure the period of time required for each of the outputs of photosensors 2*a* through 2*n* to reach a predetermined level. For example, if the output of photosensor 2*a* changes from a high (H) level to a low (L) level when a desired response is sensed, the counter 4*a* counts the number of clock signals generated before the output of photosensor 2*a* falls from the high (H) level to the low (L) level. Thus, the response times of photosensors 2*a*–2*n* correspond to the count values of counters 4*a*–4*n*.

With some modifications, the sensor array time measuring system 1 can be adapted to measure the time elapsed before the onset of a particular event. However, in conventional systems for measuring the onset times of events, the number of hardware elements required increases with the number of different events to be measured and with the length of time to be measured. In particular, a large amount of circuitry is necessary where the system must be capable of measuring a wide range of response times.

When the outputs of the sensors of known systems are quantized, it may be unnecessary to measure the response times precisely. Instead, it may be sufficient to obtain data with a degree of precision sufficient to be significant for the sensor array. If the measurement results are to be used in data processing, and if the number of sampling data is unnecessarily large, the succeeding data processing operation requires processing of insignificant data which makes it impossible to obtain data efficiently.

Accordingly, an object of the present invention is to provide a clock signal generating circuit for effectively and efficiently measuring occurrence times of a plurality of events using a relatively small amount of hardware.

SUMMARY OF THE INVENTION

To achieve the forgoing and other objects of the present invention, the clock signal generating circuit according to the present invention comprises means for generating first clock signals, means for frequency dividing the first clock signals by 1/N (N being an integer $\geqq 1$) to provide second clock signals, first counting means for counting the second clock signals until a first event occurs, second counting means for receiving both an inverted count result as an initial value from the first counting means and the first clock signals, and for counting the first clock signals up to a predetermined count, the second counting means including means for outputting a third clock signal after counting to the predetermined count.

Using the clock signal generating circuit of the present invention, the time when a first event occurs among a plurality of events is measured. Then, clock signals are formed, having a period equal to 1/N of the time until the occurrence of the first event. Time periods from the occurrence of the first event until the occurrences of other events are measured by counting the number of clock signals. As a result, even if the occurrence times of the events are changed, it is possible to accurately perform the time measurement.

BRIEF DESCRIPTION OF THE DRAWING

The manner by which the objects and features of the present invention are achieved will be fully apparent from the following detailed description when read in conjunction with the accompanying drawings, wherein.

DETAILED DESCRIPTION OF THE PREFERRED EMBODIMENT

Figure 1:
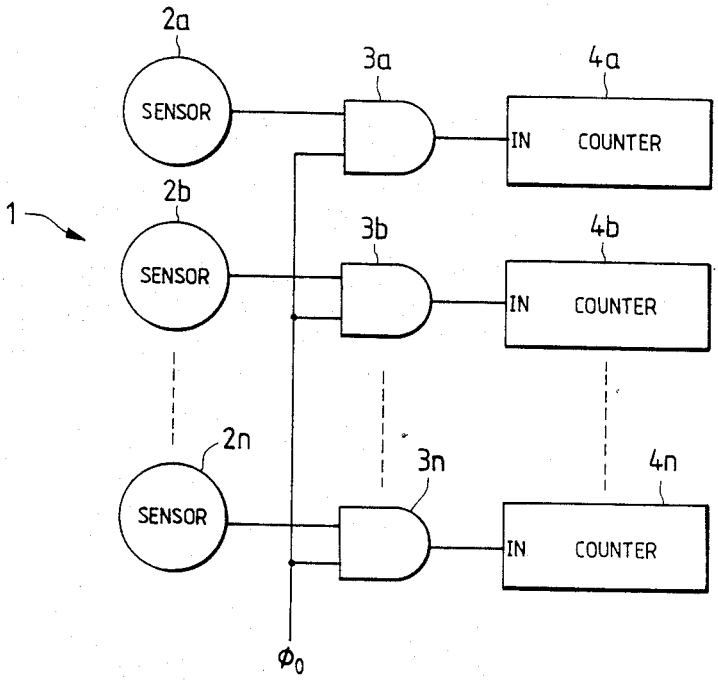
FIG. 1 PRIOR ART
FIG. 1 is a diagram of a conventional time measuring system;/
Figure 2:
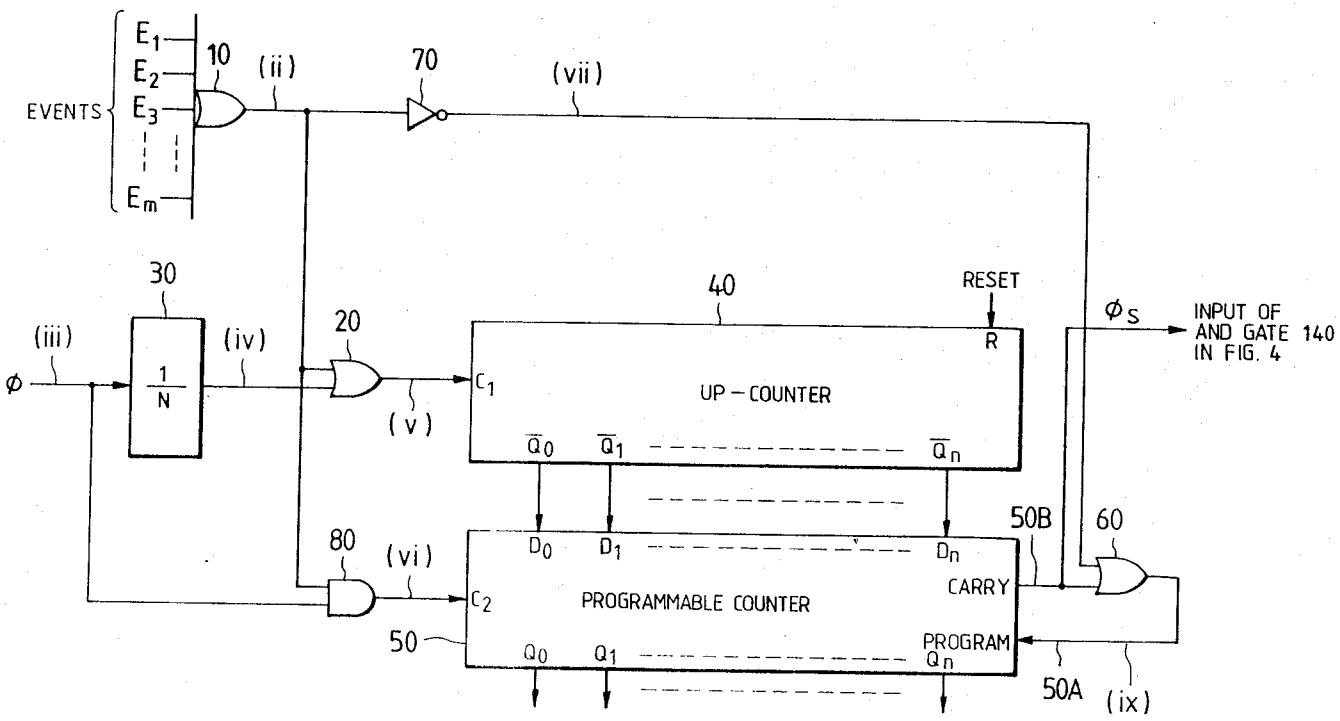
FIG. 2 is a diagram of one embodiment of the clock signal generating circuit of the present invention.
Figure 3:
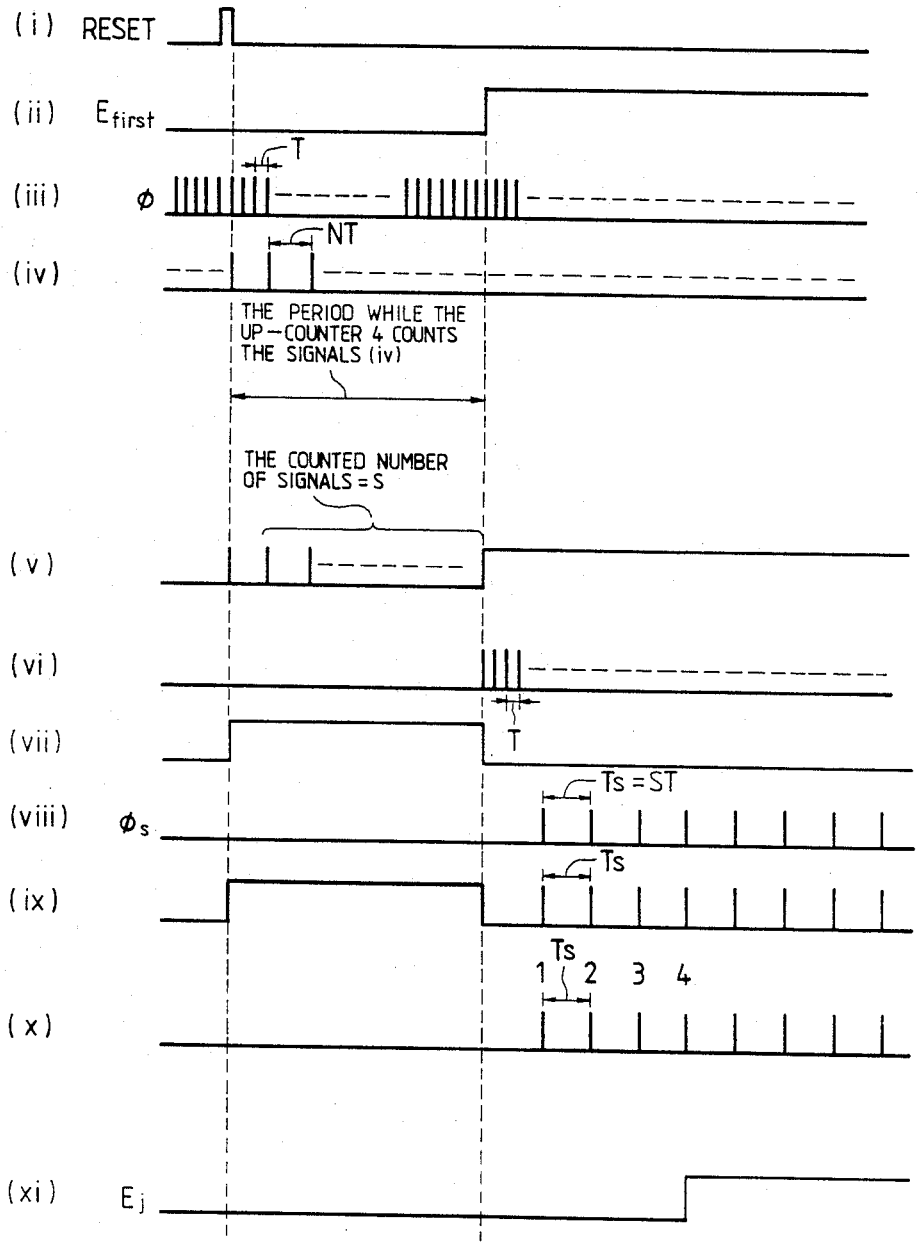
FIGS. 3(*i*) to 3 (*xi*) are time charts of signals generated during the operation of the circuits of FIGS. 2 and 4.

With reference to FIGS. 2 and 3(*i*) through 3(*xi*) a preferred embodiment of the present invention will be described in detail.

In FIG. 2, $E_1$ through $E_m$ each represents a different one of m events or signals to be time-measured. In this embodiment, the time periods from a reset pulse (FIG. 3(*i*)) until the events $E_1, E_2, \ldots, E_m$ are measured. When an event occurs, the level of the corresponding signal E changes from a binary "0" to a binary "1."

In the circuit, the signals $E_1$ through $E_m$ are supplied to the inputs of an OR gate 10. The output of the OR gate 10 is supplied to an OR gate 20, which also receives the output of a frequency divider 30 for subjecting a reference clock signal $\phi$ a 1/N frequency division. The output of OR gate 20 is supplied to a clock pulse input terminal $C_1$ of an n-bit up-counter 40. Output terminals $\overline{Q}_o, \overline{Q}_1, \ldots, \overline{Q}_n$ of up-counter 4 are connected to data input terminals $D_o, D_1, \ldots, D_n$, respectively, of a programmable counter 50. The output of OR gate 10 is inverted by an inverter 70, and supplied to an OR gate 60. A carry signal outputted from a carry terminal 50B of the programmable counter 50 is also supplied to the OR gate 60. The output of the OR gate 60 is supplied to a programming terminal 50A of the programmable counter 50. Further, the output of the OR gate 10 and the reference clock signal $\phi$ are supplied to a clock input terminal $C_2$ of the programmable counter 50.

In this embodiment, all of the event signals $E_1$ through $E_m$ are inputted to the OR gate 10. Therefore, the output of the OR gate 10 changes from binary "0" to "1", at the occurrence of the first event ($E_{first}$ (FIG. 3(*ii*)).

A reference clock signal $\phi$ (FIG. 3(*iii*)) is inputted to the 1/N frequency divider 30. Therefore, the output of this frequency divider 30 has a frequency of 1/N of the reference clock signal $\phi$. In other words, the output signal of the 1/N frequency divider 30 has a period N times as long as the period T of the reference signal $\phi$ (FIG. 3(*iv*)). The output of the 1/N frequency divider 30 is connected to the OR gate 20. Therefore, the OR gate 20 transmits the output of the 1/N frequency divider 30 to the up-counter 40 until the first event $E_{first}$ occurs. As a result, the count result (henceforth referred to as S) of the upcounter 40 corresponds to the number of clock signals outputted by the 1/N frequency divider 30 from the reset pulse until $E_{first}$ (FIG. 3(*v*)). It is noted that the up-counter 40 is also reset, at reset input R, by the reset pulse. Further, after $E_{first}$ occurs, the count result S of the up-counter 40 remains unchanged.

The count result S of the up-counter 40 is output on outputs $\overline{Q}_0, \overline{Q}_1, \ldots, \overline{Q}_n$ of the up-counter 40, and is input as an initial count value to the programmable counter 50 on programming data input terminals $D_0, D_1, \ldots, D_n$ when the input to the programming terminal 50A changes to a binary "1."

The carry signal of the carry terminal 50B of the programmable counter 50 and an inverted output of the OR gate 10 (FIG. 3(*vii*)), obtained by the inverter 70, are supplied to the OR gate 60. The output of the OR gate 60 is connected to the programming terminal 50A of the programmable counter 50. With this construction, the input to the programming terminal 50A of the programmable counter 50 remains a binary "1" until the first event $E_{first}$ occurs. Therefore, until $E_{first}$ occurs, the programmable counter 50 continues to be programmed with the output from the up-counter 40. When $E_{first}$ does occur, the input to the programming terminal 50A changes to a binary "0" and the initial value of the programmable counter 50 is set equal to the complement S of the count result $\overline{S}$ in the up-counter 4.

When $E_{first}$ occurs, the output of OR gate 10 changes to a binary "1." In response, AND gate 80 supplies the reference clock signal $\phi$ to the terminal $C_2$ of the programmable counter 50 (FIG. 3(vi)). As a result, programmable counter 50 continues counting the number of clock signals $\phi$. At the time when overflow occurs in the programmable counter 50, that is, when the programmable counter 50 reaches a count equal to $2^{n+1}$, the programmable counter 50 changes the carry signal $\phi$s into a binary "1" (FIG. 3(*viii*)). The carry signal $\phi$s is also supplied to the programming terminal 50A of the programmable counter 50 through the OR gate 60 (FIG. 3(*ix*)) such that the count result S of the up-counter 40 is again programmed into the programmable counter 50.

As described above, the programmable counter 50 repeats counting the signals $\phi$from an initial value equal to the complement $\overline{S}$ of the count result S ($=2^{n+1}-S-1$) up to the value $2^{n+1}$. That is, the programmable counter 50 repeats counting $S+1$ $\phi$ signals, where $S+1$ represents a difference between $2^{n+1}-S-1$ and $2n+1$. The number $S+1 \approx S$ when $S >> 1$. Therefore, the carry output signals $\phi$s of the programmable counter 50 act as clock signals, obtained by a 1/S frequency division of the reference clock signals $\phi$. In other words, the clock signals $\phi$s have a period $T_s$ which is S times as large as the period $T_n$ of the reference clock signals $\phi$ (FIG. 3(*viii*)).

Since E*first* occurs at a time when the number of signals having a period equal to NT, output from the 1/N frequency divider 30, have been counted up to the value S by the up-counter 40, the time duration from the reset time until E*first* occurs is equal to $N \times T \times S$. Since the period of the signals $\phi$s is ST, the carry signals $\phi$s (FIG. 3(*viii*)) from the carry terminal 50B act as clock signals having a period which is 1/N of the time period from the reset time until $E_{first}$ occurs.

As described above, according to the present invention, time periods from occurrence of a first event $E_{first}$ until the occurrence of another event are measured using carry signals $\phi$s. Therefore, even if the time of occurrence of the first event changes, it is possible to accurately measure the occurrence times of other events.

The clock signal generating circuit of FIG. 2 may be modified such that the up-counter 40 is changed to a down-counter. In such a case, the processing is performed the same, the only difference being the direction of counting.

Figure 4:
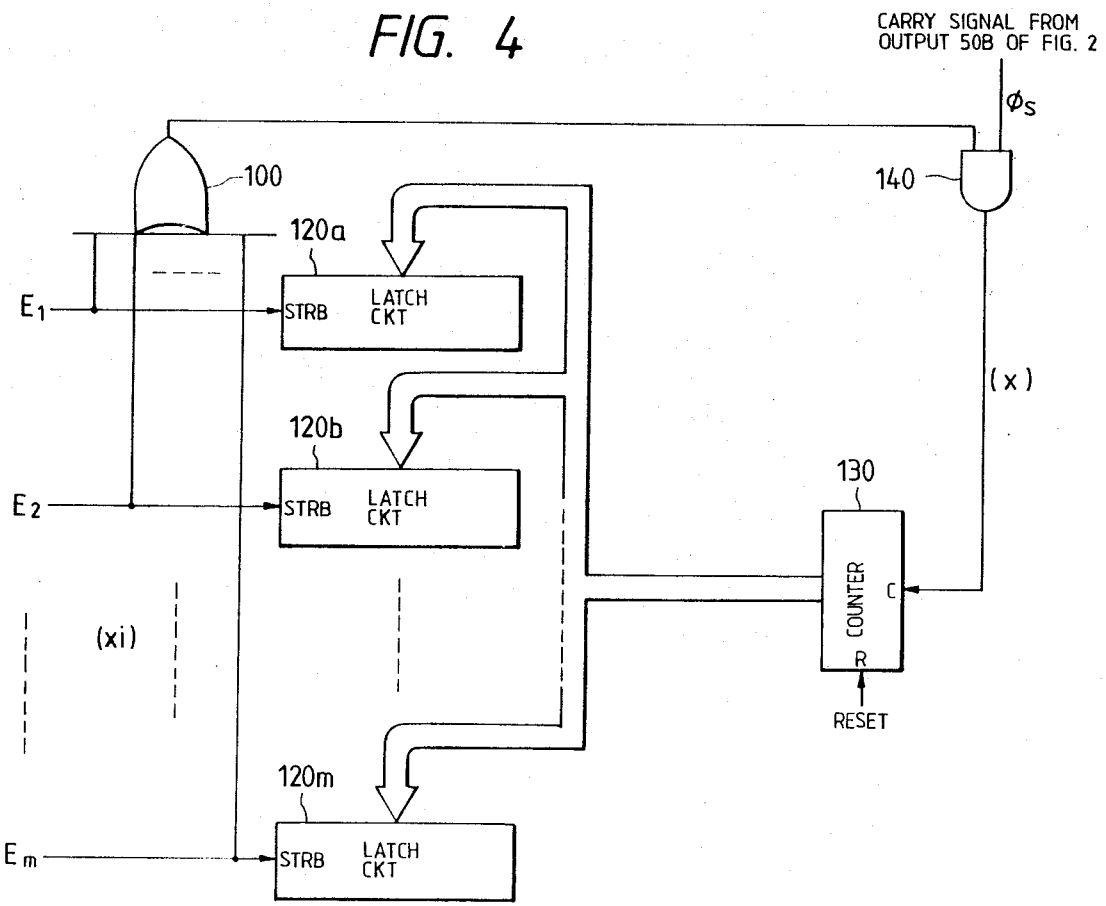
FIG. 4 is an embodiment of a time measuring system to which the clock generating circuit of the present invention is applied.

With reference to FIG. 4 and FIGS. 3(*x*) and 3(*xi*), a description is provided as to how to measure the occurrence times of a plurality of events, other than $E_{first}$, using the clock signal generating circuit of the present invention. Reference is made to U.S. Pat, No. 4,737,942 which discloses a conventional device for measuring a plurality of events.

In FIG. 4, reference numeral 100 corresponds to the OR gate 10 of FIG. 2, and reference numerals 120*a* through 120*m* designate latch circuits which latch the output of a counter 130 when signals at their strobe input terminals STRB are raised from binary "0" to binary "1." Reference numeral 140 designates an AND gate into which the output of the OR gate 100 and carry signals $\phi_s$ from the carry terminal 50B of the programmable counter 50 of FIG. 2 are input.

With such a construction, until the occurrence of the first event $E_{first}$, the output of the OR gate 100 remains a binary "0", and the AND gate 140 does not pass the clock signals $\phi$s to the counter 130. When $E_{first}$ does occur, as shown in FIG. 3(*ii*), the output of the OR gate 100 changes to a binary "1," and the AND gate 140 passes the carry signals $\phi_s$ to the counter 130 (FIG. 3(*x*)). In response, the counter 130 starts counting the clock signals $\phi_s$. When another event $E_j$ occurs, as shown in FIG. 3(*xi*), the signal $E_j$ is used as a strobe signal for the corresponding latch circuit $120_j$ to latch the content of the counter 130 into the latch circuit $120_j$. This count represents the amount of time between $E_{first}$ and $E_j$. In the example of FIG. 3(*xi*), the value "3" is recorded in the latch circuit 120*j*. When $E_{first}$ occurs, the content of the counter 130 is "0", and "0" is recorded in the latch circuit $120_x$ to which the event $E_x$ ($E_{first}$) occurring first among the events $E_1$ through $E_m$ is applied. Thus, data representing the time of occurrence of the events $E_1$ through $E_m$ are recorded in the corresponding latch circuits $120_a$ through $120_m$ with the time that the first event $E_{first}$ occurred being the reference point (t=0).

As is apparent from the above description, according to the present invention, the time of occurrence of a first event among a plurality of events can be measured. Clock signals for measuring the time period from the first event until another event are formed, based on the time of occurrence of the first event. As a result, even if the time of occurrence of the first event is changed it is possible to accurately measure the time of occurrence of another event.

While the present invention has been described in terms of the foregoing embodiments, it should be understood that modifications may be made thereto without departing from the spirit and scope of the invention as defined in the appended claims.

What is claimed is:

1. A circuit for generating clock signals, comprising:

means for generating firt clock signals;

means for frequency dividing said first clock signals by 1/N (N being an integer ≧1) to provide second clock signals;

first counting means for counting said second clock signals until a first event occurs;

second counting means for receiving both a count result as an initial value from said first counting means and said first clock signals, and for counting said first clock signals up to a predetermined count; said second counting means including means for outputting a third clock signal after counting to said predetermined count;

resetting means for resetting said second counting means back to said initial value after said second counting means counts to said predetermined value;

first gage means for outputting a first event signal to each of said first and second counting means when said first event occurs;

second gate means for supplying said second clock signals to said first counter means in response to said first event signal; and third gate means for supplying said first clock signals to said second counter means in response to said first event signal.

2. A circuit for counting a time period between the occurrences of a plurality of events, comprising:

means for generating first clock signals;

means for frequency dividing said first clock signals by 1/N (N being an integer ≧1) to provide second clock signals;

first counting means for counting said second clock signals until a first event occurs;

second counting means for receiving both a count result as an initial value from said first counting means and said first clock signals, and for counting said first clock signals up to a predetermined count, said second counting means including means for outputting a third clock signal after counting to said predetermined count;

resetting means for resetting said second counting means back to said initial value after said second counting means counts to said predetermined count, such that said second counting means outputs a third clock signal each time said second counting means counts from said initial value to said predetermined count;

a plurality of latch circuits corresponding to a plurality of subsequent events, respectively;

third counting means for counting said third clock signals after said first event occurs, and for outputting a count value to each of said plurality of latch circuits; and means for latching one of said latching circuits corresponding to the occurrence of a subsequent event, such that said count value in said one of said latching circuits represents a period of time from said first event to said subsequent event.

3. a circuit for generating clock signals according to claim 2, further comprising:

first gate means for outputting a first event signal to each of said first and second counting means when said first even occurs;

second gate means for supplying said second clock signals to said first counter means in response to said first event signal;

third gate means for supplying said first clock signals to said second counter means in response to said first event signal; and fourth gate means for supplying said third clock signals to said third counting means in response to said first event signal.

4. A method of generating clock signals, comprising the steps of:

a) generating first clock signals;

b) generating second clock signals by frequency dividing said first clock signals by 1/N (N being an integer ≧1);

c) counting said second clock signals until a first event occurs and outputting a first count result as an initial value;

d) counting said first clock signals from said initial value to a predetermined count;

e) outputting a third clock signal after counting to said predetermined count;

f) repeating steps d) and e) so as to output a plurality of third clock signals;

g) counting said plurality of third clock signals to a second count result;

h) outputting said second count result to a plurality of latch circuits corresponding to a plurality of subsequent events, respectively;

i) latching a predetermined latching circuit corresponding to a subsequent event at the occurrence of said subsequent event, said second count result latched in said predetermined latching circuit corresponding to a time between the occurrence of said first event and said subsequent event.

* * * * *

UNITED STATES PATENT AND TRADEMARK OFFICE

CERTIFICATE OF CORRECTION

PATENT NO. : 4,958,362

DATED : September 18, 1990

INVENTOR(S) : Takashi Nishibe et al.

It is certified that error appears in the above-identified patent and that said Letters Patent is hereby corrected as shown below:

Claim 1, Column 5, Line 5, change "firt" to --first--;

Claim 1, Column 5, Line 22, change "gage" to --gate--;

Claim 3, Column 6, Line 12, change "a" to --A--;

Claim 3, Column 6, Line 16, change "even" to --event--;

Column 2, Line 20, delete [/].

Signed and Sealed this

Twenty-second Day of December, 1992

*Attest:*

DOUGLAS B. COMER

*Attesting Officer*

*Acting Commissioner of Patents and Trademarks*